US006945919B2

(12) United States Patent
Yang

(10) Patent No.: US 6,945,919 B2
(45) Date of Patent: Sep. 20, 2005

(54) BALANCE-EXERCISING SEMI-SPHERICAL APPARATUS

(76) Inventor: Lien Chuan Yang, 11F-1, No. 149, Sec. 3, Roosevelt Rd., Taipei (TW)

( * ) Notice: Subject to any disclaimer, the term of this patent is extended or adjusted under 35 U.S.C. 154(b) by 115 days.

(21) Appl. No.: 10/617,383

(22) Filed: Jul. 11, 2003

(65) Prior Publication Data

US 2005/0009677 A1 Jan. 13, 2005

(51) Int. Cl.[7] ..... A63B 22/00
(52) U.S. Cl. ..... 482/142; 482/141; 482/51
(58) Field of Search ..... 482/121–130, 482/132, 140, 142, 146, 148

(56) References Cited

U.S. PATENT DOCUMENTS 4,159,826 A * 7/1979 Hancock ..... 482/26
5,833,587 A * 11/1998 Strong et al. ..... 482/123
6,422,983 B1 * 7/2002 Weck ..... 482/147
6,461,284 B1 * 10/2002 Francavilla ..... 482/142
6,554,753 B1 * 4/2003 Weck et al. ..... 482/147
6,702,726 B2 * 3/2004 Lin ..... 482/148
6,746,372 B2 * 6/2004 Hsu ..... 482/34

* cited by examiner

*Primary Examiner*—Gregory L. Huson
*Assistant Examiner*—Tam Nguyen
(74) *Attorney, Agent, or Firm*—Troxell Law Office, PLLC

(57) ABSTRACT

A balance-exercising semi-spherical apparatus has an annular frame and a fixing ring sequentially fixed on a base disk; the base disk is connected on two diametrically mutually opposite ends thereof with two movable pulling ropes, and has thereon a hole for connecting an external aeration equipment. The annular frame is in the form of a semi-sphere with an air cushion therewithin, the air cushion connects an air faucet; the air faucet is used to aerate the air cushion to form a semi-sphere through the external aeration equipment. Thereby, a user can hold the pulling ropes on the two diametrically mutually opposite ends of the base disk with hands to tread, jump, seat and lie on the air cushion for exercising for health and balance exercising.

5 Claims, 7 Drawing Sheets

BALANCE-EXERCISING SEMI-SPHERICAL APPARATUS

BACKGROUND OF THE INVENTION

1. Field of the Invention

The present invention is related to an exercising implement, and especially to a balance-exercising semi-spherical apparatus of which the structure is simple, the assembling is easy, it allows a user to hold pulling ropes provided thereon with hands to tread, jump, seat and lie on an air cushion, and is suitable used as an implement for exercising for health, balance exercising and games.

2. Description of the Prior Art

Following developments of science and technology and changing of the society, people of modern time are getting busier, and thereby neglect their health; and population of people is huge now; whenever a holiday, grounds for leisure are crowded with tides of people, spaces for leisure and sports relatively get fewer and fewer; therefore, gymnastic centers have been developed and surely solve a part of the problem of lacking spots for sports. However, gymnastic centers are not distributed all over every district, and costs to join them are very expensive that normal people can not afford; in contrast, to purchase desired gymnastic implements directly for placing in homes not only can save time and money, but also can have advantage of making excise at any time.

Gymnastic implements sold in the markets are various, such as treadmills, rowboat exercising apparatus, exercising bicycles etc., they are all structurally large and require adequate space for placing; they are expensive that normal people can not afford; and each of them only has a single function and is unable to get many types of actions.

In view of the above stated, the inventor of the present invention got a motive to study and provide a balance-exercising semi-spherical apparatus which does not occupy too much space, can get many types of actions and can get the goal of exercising, health achieving and playing games.

SUMMARY OF THE INVENTION

The primary object of the present invention is to provide a balance-exercising semi-spherical apparatus of which the structure is simple, the assembling is easy, it allows a user to hold pulling ropes provided thereon with hands to tread, jump, seat and lie on an air cushion.

To get the object, the balance-exercising semi-spherical apparatus of the present invention comprises: a base disk having thereon a receiving recess, the base disk having a hole for connecting an external aeration equipment, and having two connecting portions on two diametrically mutually opposite ends thereof; two pulling ropes made of elastic material, one end of each pulling rope having a handle, the other end having a connecting member to render the pulling rope to detachably connect with the connecting portion on a corresponding end of the base disk; an annular frame in the form of a semi-sphere with an air cushion therewithin, the air cushion connecting an air faucet, the annular frame being able for placing on and connecting to the base disk, the air faucet being used to aerate the air cushion to form a semi-sphere through the external aeration equipment; a fixing ring connecting with the base disk, the annular frame then being able to fix tightly on the base disk.

Thereby, the user can hold with his hands the two pulling ropes on the two diametrically mutually opposite ends of the base disk to tread, jump, seat and lie on the air cushion for exercising for health.

The present invention will be apparent after reading the detailed description of the preferred embodiment thereof in reference to the accompanying drawings.

DETAILED DESCRIPTION OF THE PREFERRED EMBODIMENT

Figure 1:
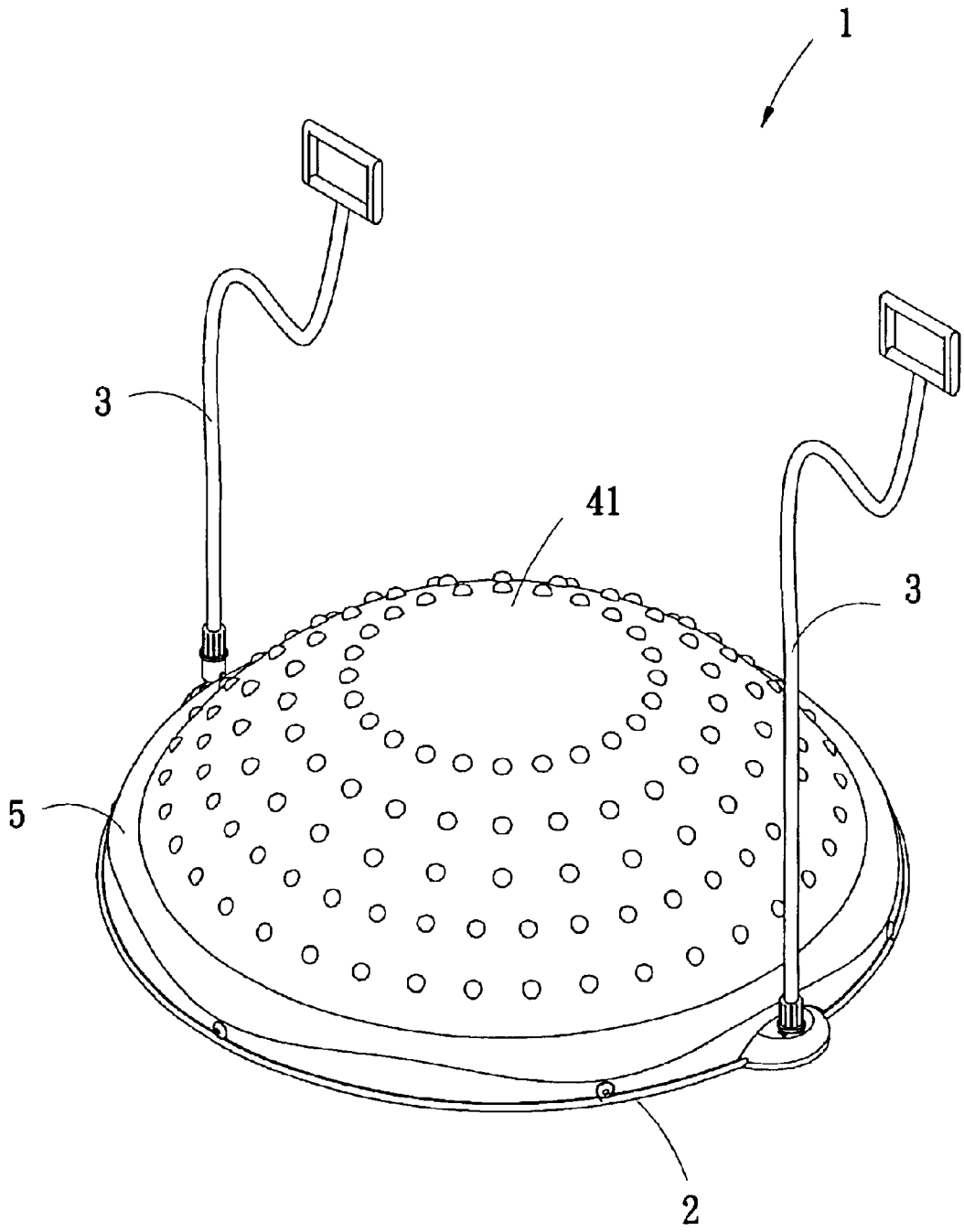
FIG. 1 is a perspective view showing the appearance of an embodiment of a balance-exercising semi-spherical apparatus of the present invention.
Figure 2:
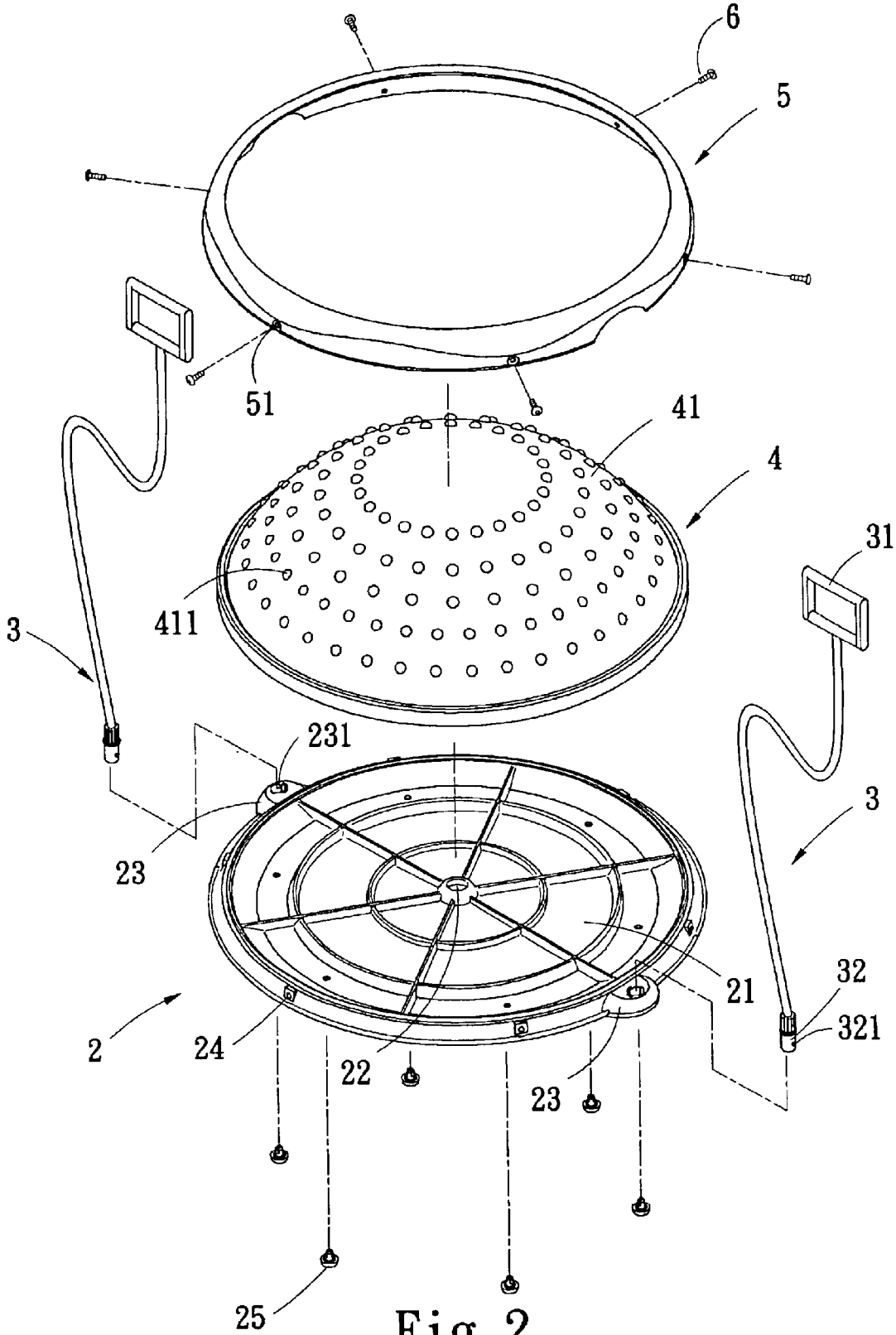
FIG. 2 is an analytic perspective view showing the elements of the embodiment of the present invention.

Referring firstly to FIGS. 1, 2 showing an embodiment of a balance-exercising semi-spherical apparatus 1 of the present invention which comprises a base disk 2, two pulling ropes 3, an annular frame 4 and a fixing ring 5; wherein:

The base disk 2 has thereon a receiving recess 21, and has at its center a hole 22 for connecting an external aeration equipment (not shown), and has two connecting portions 23 on two diametrically mutually opposite ends thereof protruding out of the periphery of the base disk 2. The connecting portions 23 each having an insertion hole 231 for connecting thereto the two pulling ropes 3. The base disk 2 is provided on the periphery thereof with a plurality of connecting holes 24 to connect the annular frame 4; and is provided on the bottom thereof with a plurality of footings 25 to support the base disk 2.

The pulling ropes 3 are made of elastic material, one end of each pulling rope 3 has a handle 31, the other end has a connecting member 32 having thereon an engaging stub 321 which can be extended and screwed into the insertion hole 231 of the corresponding one of the connecting portions 23, so that the pulling ropes 3 can be detachably connected to the connecting portions 23.

The annular frame 4 is in the form of a semi-sphere with an air cushion 41 therewithin and with a lot of massaging protrusions 411 on the surface thereof, the air cushion 41 connects an air faucet 42 (referring to FIG. 3), the annular frame 4 can be placed on and connected to the base disk 2, the air faucet 42 is used to aerate the air cushion 41 to form a semi-sphere through the external aeration equipment connecting with the base disk 2.

The fixing ring 5 is provided on the periphery thereof with a plurality of holes 51 in confronting respectively with the connecting holes 24 provided on the periphery of the base disk 2, so that when the fixing ring 5 is connected with the base disk 2, the annular frame 4 can be fixed tightly on the base disk 2.

Figure 3:
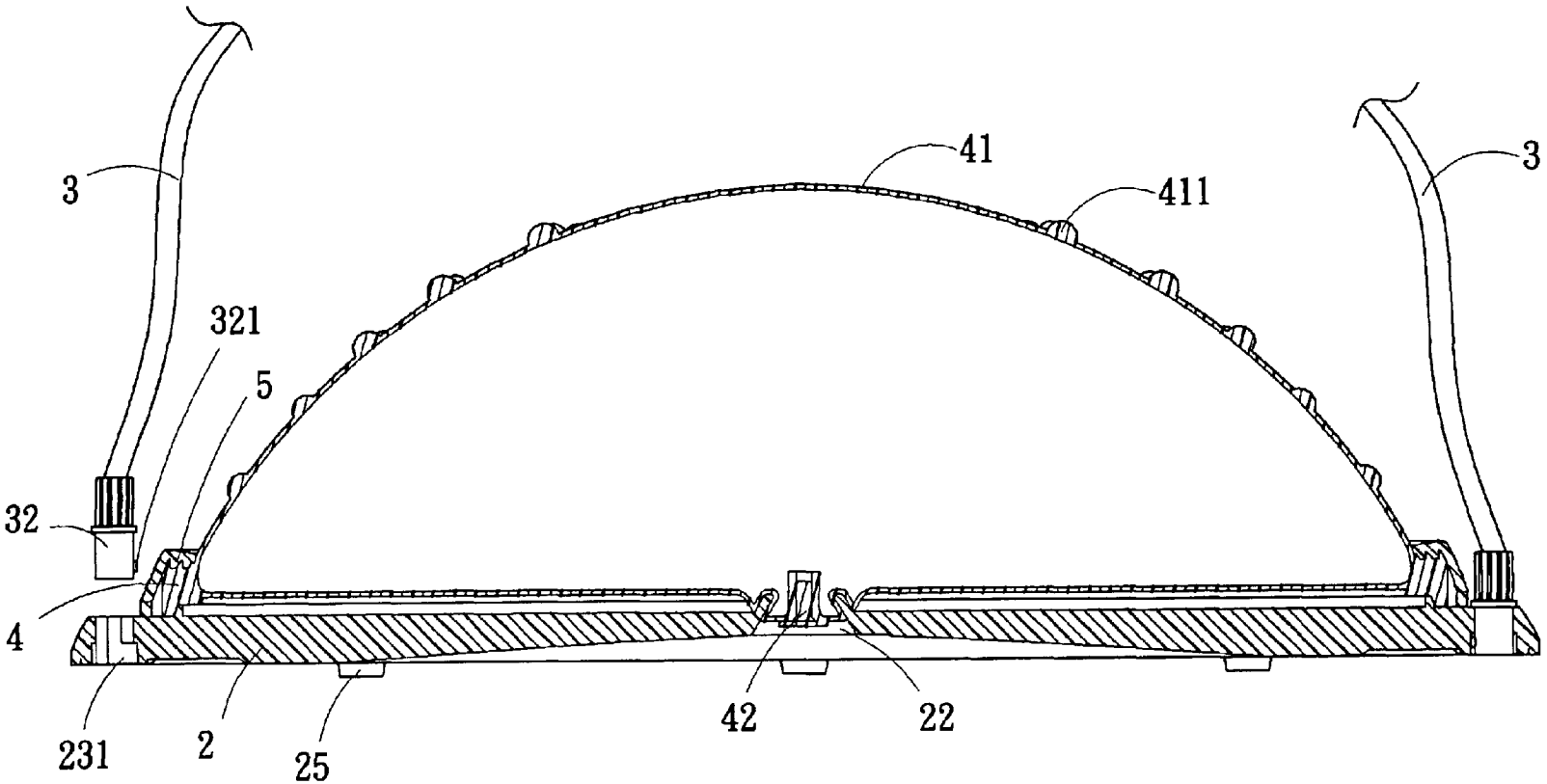
FIG. 3 is a sectional view of the embodiment of the present invention.
Figure 4:
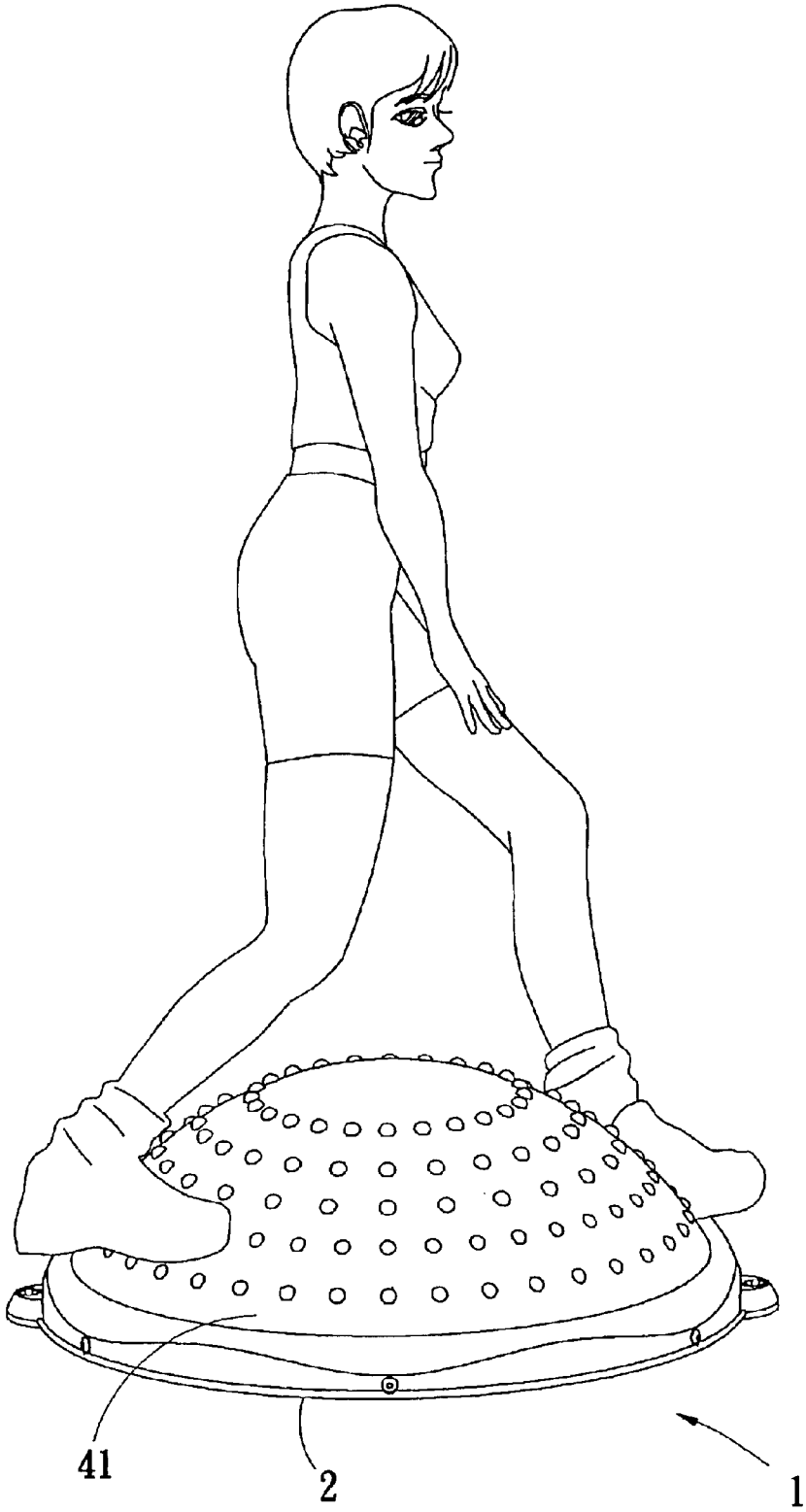
FIG. 4 is a schematic view showing use by a user on an air cushion of the present invention for treading exercise.
Figure 5:
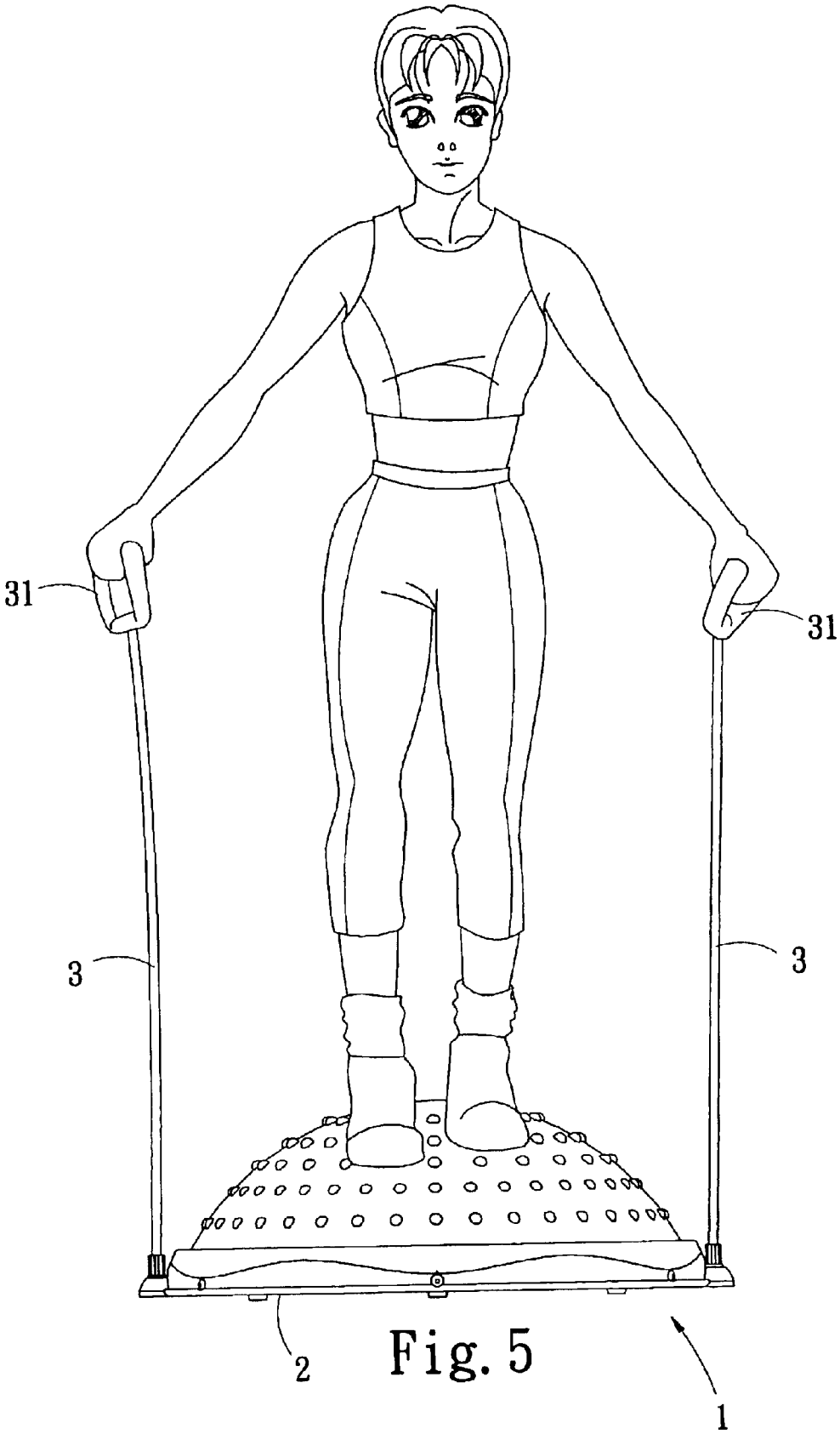
FIG. 5 is a schematic view showing using pulling ropes on the air cushion of the present invention for exercising.
Figure 6:
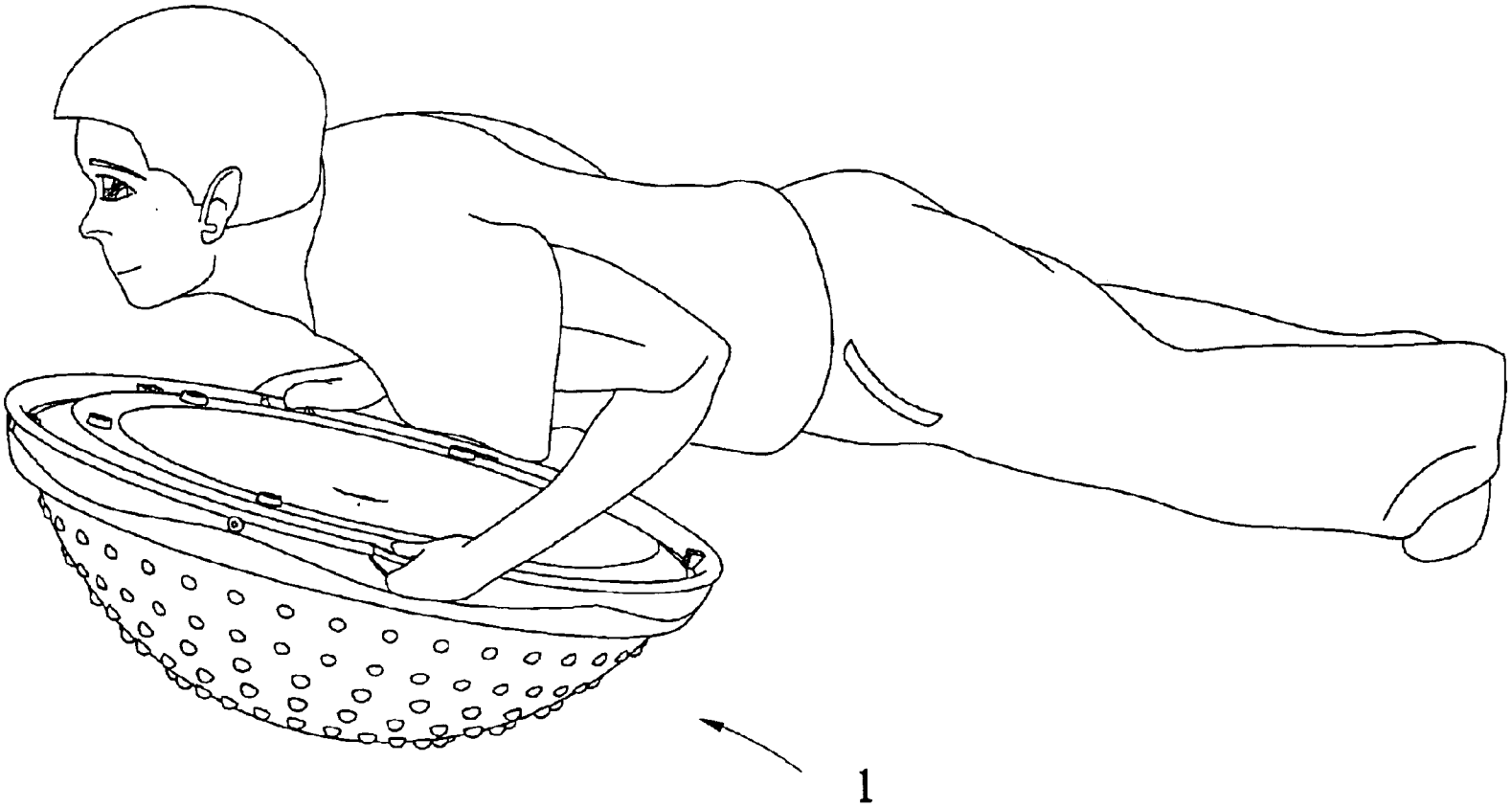
FIG. 6 is a schematic view showing use on the air cushion of the present invention for push-up exercise.
Figure 7:
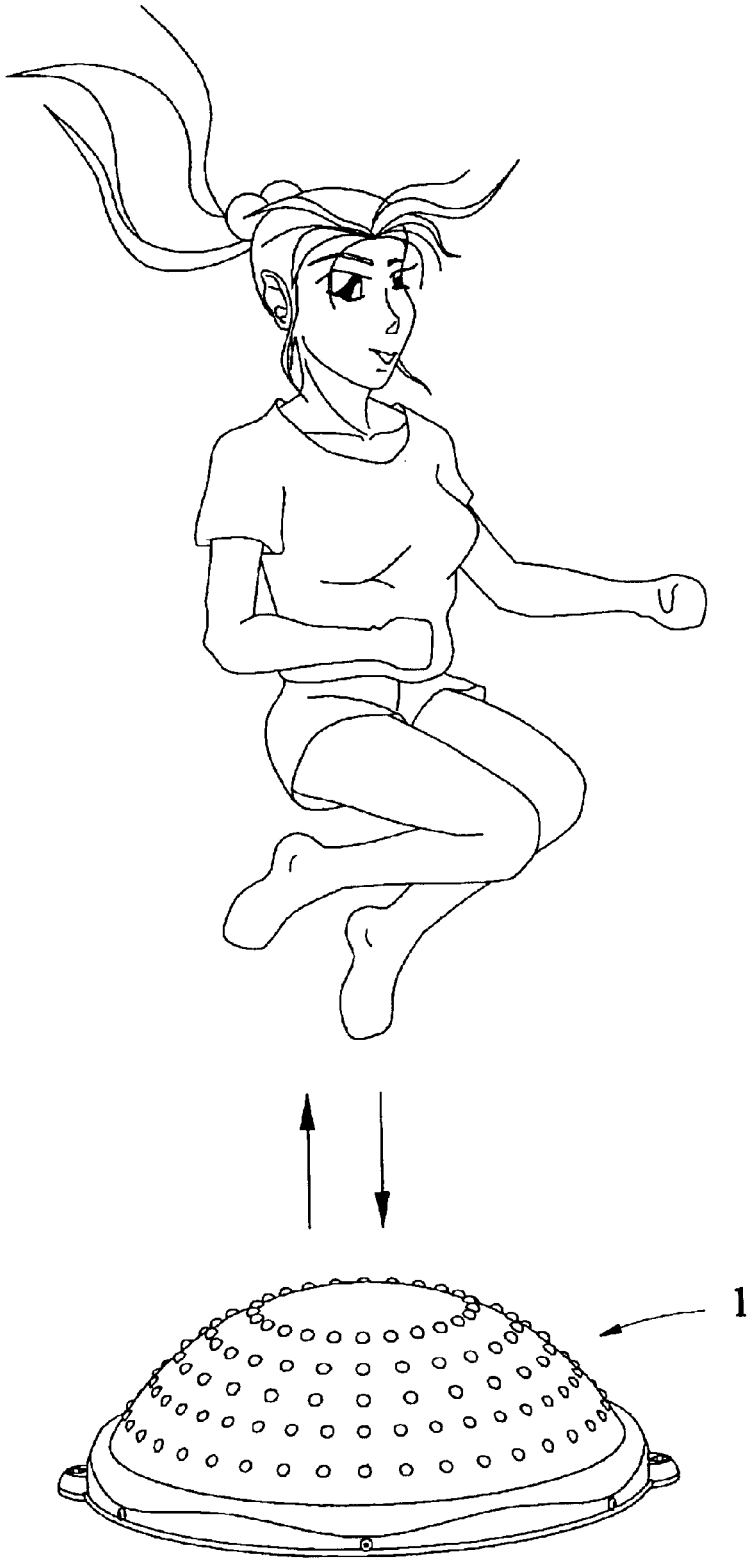
FIG. 7 is a schematic view showing use on the air cushion of the present invention for jumping exercise.

When in practicing, as shown in FIGS. 2 and 3, the annular frame 4 is placed in the receiving recess 21 of the base disk 2; the air faucet 42 in connecting with the air cushion 41 is engaged in the central hole 22 of the base disk 2. Thereby, when the air cushion 41 is to connect with the external aeration equipment, air will be filled into the air cushion 41 through the air faucet 42; and when the annular frame 4 is full filled to form a semi-sphere, the fixing ring 5 is pressed down against the annular frame 4 to make the holes 51 of the fixing ring 5 align with the connecting holes 24 on the base disk 2 and to firmly lock them together with screws 6; lastly, the pulling ropes 3 are respectively insertion connected into the insertion holes 231 of the connecting portions 23 of the base disk 2 to form the balance-exercising semi-spherical apparatus 1.

Therefore, as shown in FIGS. 4–7, a user can tread, jump, seat and lie on the semi-spherical air cushion 41 for exercising for health and balance exercising, and can hold the pulling ropes 3 provided on two sides of the base disk 2 with hands to perform more variant actions.

The present invention thereby has the following advantages:

1. The balance-exercising semi-spherical apparatus of the present invention is structurally simple, easy for assembling, it does not occupy too much space, but is convenient for carrying, it can get the goal of exercising at will indoors or outdoors.
2. The present invention is not limited to an exercising type, it can be cooperatively operated with the pulling ropes provided on two sides of the base disk to make different exercising such as treading, jumping, balancing in seating and lying and exercising for health.
3. The air cushion of the present invention is provided with a lot of massaging protrusions on the surface of the air cushion to provide the effects of massaging and skid proofing.

In conclusion, the present invention can surely achieve its expected object to provide a balance-exercising semi-spherical apparatus with extremely large practicable value.

Having thus described my invention, what I claim as new and desire to be secured by Letters Patent of the United States are:

1. A balance-exercising semi-spherical apparatus comprising:

a base disk having thereon a receiving recess, having a hole for connecting an external aeration equipment, and having two connecting portions on two diametrically mutually opposite ends thereof;

two pulling ropes made of elastic material, one end of each of said pulling ropes having a handle, the other end having a connecting member, so that said pulling ropes are detachably connected to said connecting portions on said two diametrically mutually opposite ends of said base disk;

an annular frame in the form of a semi-sphere with an air cushion therewithin, said air cushion connecting an air faucet, said annular frame being placed on and connected to said base disk, said air faucet being used to aerate said air cushion to form a semi-sphere through said external aeration equipment connecting with said base disk;

a fixing ring connected with said base disk, said annular frame being fixed tightly on said base disk;

thereby, a user is allowed to hold with his hands said two pulling ropes on said two diametrically mutually opposite ends of said base disk to tread, jump, sit and lie on said air cushion for exercising for health, wherein said other end of each of said pulling ropes having said connecting member has thereon an engaging stub, said connecting portions on said two diametrically mutually opposite ends of said base disk protrude out of the periphery of said base disk; said connecting portions each has an insertion hole to allow extending and screwing of said engaging stubs therein for connecting the ropes to the base disk.

2. The balance-exercising semi-spherical apparatus as in claim 1, wherein said air cushion is provided with massaging protrusions on the surface thereof.

3. The balance-exercising semi-spherical apparatus as in claim 1, wherein said base disk is provided on the bottom thereof with a plurality of footings to support said base disk.

4. The balance-exercising semi-spherical apparatus as in claim 1, wherein said hole on said base disk is provided at the center of said base disk.

5. The balance-exercising semi-spherical apparatus as in claim 1, wherein said base disk is provided on the periphery thereof with a plurality of connecting holes to connect said annular frame; said fixing ring is provided on the periphery thereof with a similar plurality of holes that respectively mirror said connecting holes provided on said periphery of said base disk such that the annular frame mat be locked between the base disk and the fixing ring with a plurality of screws that connects both sets of holes.

* * * * *